US005944140A

United States Patent [19]

Takahashi

[11] Patent Number: 5,944,140

[45] Date of Patent: Aug. 31, 1999

[54] FOOTHOLD PROVIDED WITH REFLECTORS

[75] Inventor: Eizo Takahashi, Soka, Japan

[73] Assignee: Miyama Kogyo Kabushiki Kaisha, Saitama-ken, Japan

[21] Appl. No.: 09/223,410

[22] Filed: Dec. 30, 1998

[30] Foreign Application Priority Data

Aug. 20, 1998 [JP] Japan ..... 10-249062

[51] Int. Cl.[6] ..... E02O 29/12

[52] U.S. Cl. ..... 182/92; 182/90; 182/129

[58] Field of Search ..... 182/90, 92, 129

[56] References Cited

U.S. PATENT DOCUMENTS 4,778,032 10/1988 Takahashi ..... 182/90
5,752,579 5/1998 Takahashi .
5,772,358 6/1998 Takahashi .

FOREIGN PATENT DOCUMENTS 2819106 8/1998 Japan .

*Primary Examiner*—Alvin Chin-Shue
*Attorney, Agent, or Firm*—Flynn, Thiel, Boutell & Tanis, P.C.

[57] ABSTRACT

A foothold provided with reflectors capable of preventing reflectors having different colors from being erroneously attached to the foothold, of securing unity of the positions of the footholds in respect of right and left colors thereof without fixing the foothold again to the body, of sufficiently serving as a channel mark, and of being used for a long period of time since given colors are provided at given positions even if the foothold is fixed to the body while the front and back thereof are turned upside down. The foothold provided with reflectors comprise a tread and side portions continued and positioned at both sides of the tread, wherein the foothold further comprises a set of reflector members composed of upper and lower reflectors each having an elbow shape as viewed from the tops thereof and different colors, a convex portion being formed on the back surface of one reflector having one color while a concave portion being formed on the back surface of another reflector having another color, a concave portion and a convex portion being formed on the foothold corresponding to the convex portion and the concave portion of each reflector, respective reflectors being retained by the foothold so as to cover the upper and lower surfaces and the front and rear surfaces of the tread and the side portions with respective reflector members at both corners formed between the tread and side portions, and the color of the upper reflector at one corner being the same as that of the lower reflector at the other corner.

3 Claims, 3 Drawing Sheets

FOOTHOLD PROVIDED WITH REFLECTORS

BACKGROUND OF THE INVENTION

1. Field of the Invention

The present invention relates to a foothold comprising a tread and side portions and provided with reflectors continued and positioned at both sides of the tread.

2. Prior Art

A conventional foothold provided with reflectors is, for example, disclosed in Japanese Patent Laid-Open Publication No. 9-195295 wherein the foothold comprises a tread and side portions continued and positioned at both sides of the tread, and wherein reflectors each having an elbow-shape as viewed from the plane thereof are connected vertically to form a set of reflector members, and also wherein upper and lower surfaces, front and rear surfaces of the tread and upper and lower surfaces and inner and outer surfaces of the side portions at corners formed between the tread and side portions are respectively covered with the reflector members, and also wherein the colors of the reflector member at one corner are different from those of the reflector member at the other corner.

Meanwhile, in the conventional foothold, the position of the tread on which a person gets on and off even in a dark environment can be clearly confirmed, and also the foothold from the remote portions, particularly from the side portions, can be easily confirmed so that a person cannot suffer any inconvenience in case of an emergency. Further, since the colors of reflector member at one corner are different from those of the reflector member at the other corner, the right and left positions of the foothold are made clear, and particularly, the upstream and downstream of the river, etc. can be made clear to serve as a channel or direction mark. However, if parts of the footholds are fixed to a manhole body, a river water body, etc. (hereinafter simply referred to as body) while respective fronts and backs of the footholds are arranged reversibly when a series of footholds are arranged vertically, part of the colors are reversed, so that the positions of the footholds in respect of right and left colors have lack of unity, resulting in unsuccessful channel (i.e., directional) marking, and in the deterioration of design thereof. Further, since the upper and lower portions of the reflectors are combined with each other to form a set of reflector members, the reflector members are liable to be shaky relative the foothold when it is used for a long period of time.

SUMMARY OF THE INVENTION

The present invention has been made in view of the problems of the conventional foothold, and it is an object of the present invention to provide a foothold provided with reflectors capable of preventing the erroneous attachment of the reflectors of different colors to the foothold, and of securing unity of the positions of right and left colors of the foothold without mounting again the foothold even if some footholds of many footholds are mounted on the body while they are turned upside down, namely, the front and back of the footholds are reversed when arranging many footholds vertically on the body, thereby sufficiently serving as a direction mark with an excellent design, and capable of enduring a long period of use.

To achieve the above object, the foothold provided with reflectors comprise a tread and side portions continued and positioned at both sides of the tread, wherein the foothold further comprises a set of reflector members composed of upper and lower reflectors each having an elbow shape as viewed from the tops thereof and different colors, a convex portion being formed on the back surface of one reflector having one color while a concave portion being formed on the back surface of another reflector having another color, a concave portion and a convex portion being formed on the foothold respectively corresponding to the convex portion and the concave portion of each reflector, respective reflectors being retained by the foothold so as to cover the upper and lower surfaces and the front and rear surfaces of the tread and the side portions with respective reflector members at both corners formed between the tread and side portions, and the color of the upper reflector at one corner being the same as that of the lower reflector at the other corner.

Further, in the foothold provided with reflectors, the upper reflector of one corner and the lower reflector of the other corner are red, while the lower reflector of one corner and the upper reflector of the other comer are green.

PREFERRED EMBODIMENT OF THE INVENTION

Figure 1:
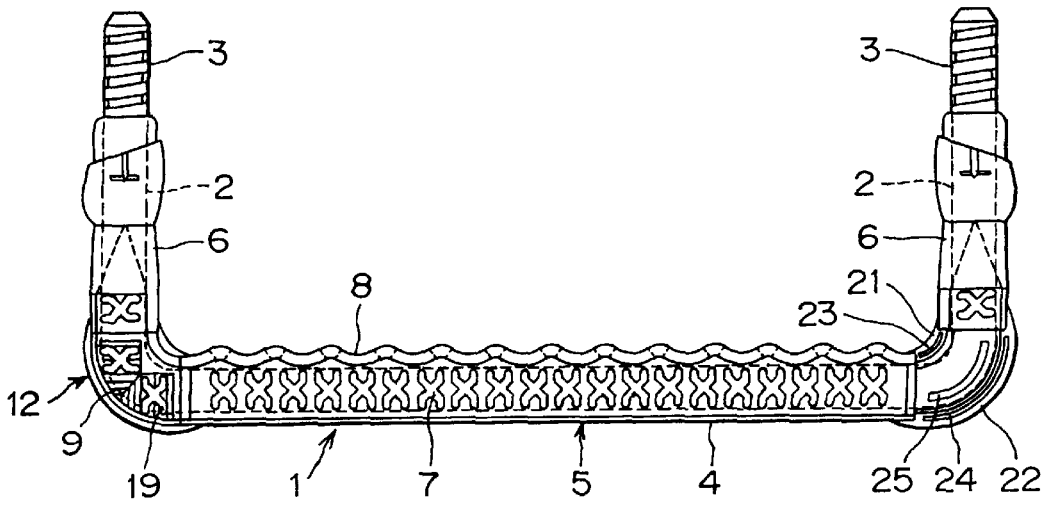
FIG. 1 is a plan view of a foothold according to a preferred embodiment of the present invention.
Figure 2:
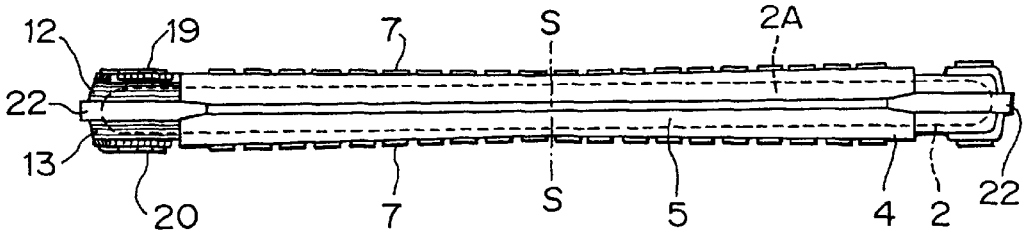
FIG. 2 is a front view of the foothold of FIG. 1.
Figure 3:
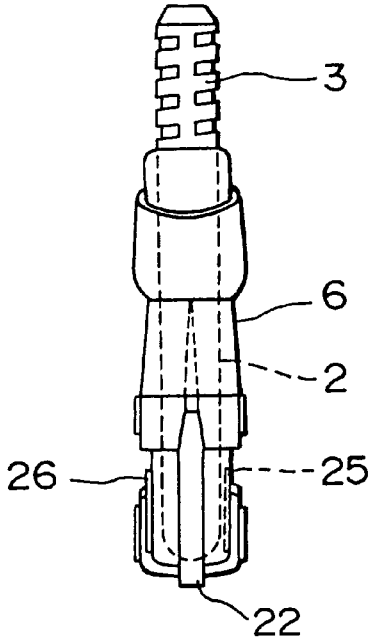
FIG. 3 is a right side elevational view of the foothold of FIG. 1.
Figure 4:
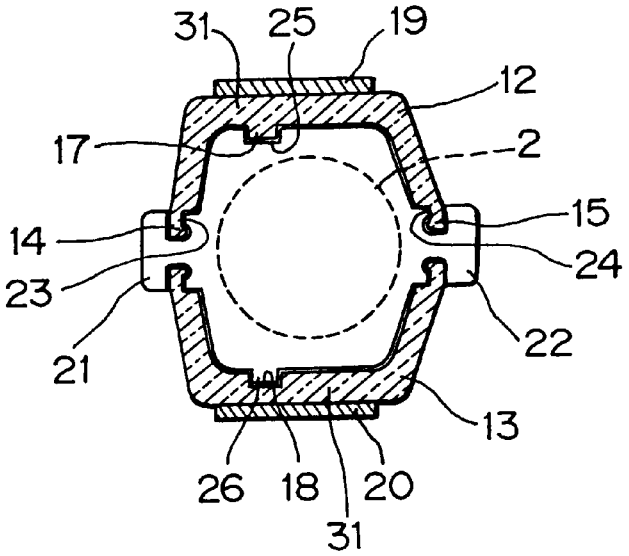
FIG. 4 is a cross-sectional view at the corner for explaining the attachment of both reflectors to the foothold.
Figure 5A:
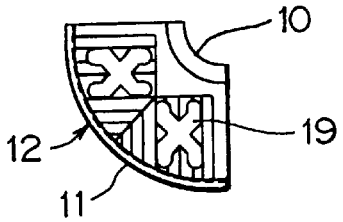
FIGS. 5(A) to 5(D) are views for explaining the construction of one reflector member.
Figure 5B:
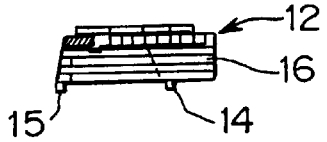
Figure 5C:
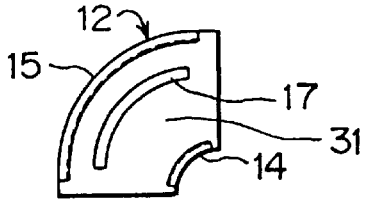
Figure 5D:
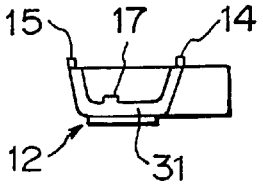
Figure 6A:
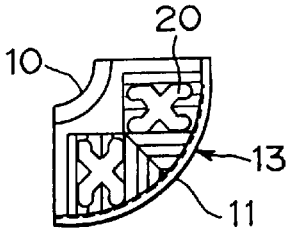
FIG. 6(A) to 6(D) are views for explaining the construction of another reflector member.
Figure 6B:
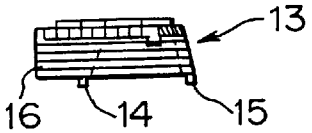
Figure 6C:
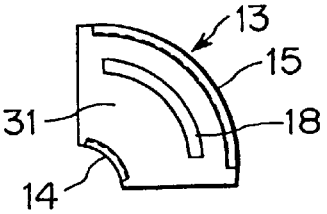
Figure 6D:
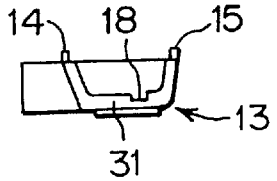

FIGS. 1 and 6 show a foothold provided with reflectors according to a preferred embodiment of the invention wherein FIG. 1 is a plan view for explaining the foothold, FIG. 2 is a front view thereof, FIG. 3 is a right side elevational view thereof, FIG. 4 is a view for explaining the attachment of the reflectors to the foothold, and FIGS. 5 and 6 are views for explaining respective reflectors constituting reflector members.

In the same figures denoted by 1 is an entire foothold having a U-shape as viewed from the plane thereof and comprising a U-shaped core 2 made of iron, and having a bight 2A joined between legs 3 thereof, and a coating of synthetic resin 4 such as polypropylene which covers the bight 2A and legs 3 except a part thereof in view of rust prevention. The foothold 1 is fixed to a manhole or a river wall in a state where the foothold 1 is embedded in concrete of the manhole or that of the river wall at the portion where the legs 3 which are not covered with the synthetic resin 4.

Denoted by 5 is a tread formed on the foothold 1, and 6 are side portions continued and positioned at both sides of the tread 5. The tread 5 and side leg portions 6 are defined by the core 2 and the resin coating 4. A slip prevention pattern 7 is formed on the upper and lower surfaces of the tread 5 in the axial direction thereof to prevent a foot or feet of a person from sliding. A corrugated grip portion 8 is formed on the inner side surface of the tread 5 also in the axial direction thereof, so that the person can grip it by hands. Reflector members 9 are provided at both corners formed between the tread 5 and the side portions 6, as described later.

Next as shown in FIG. 2, the entire periphery of the horizontal linear bight 2A is covered with the synthetic resin 4, and the synthetic resin 4 increases in thickness from the central plane S to the side portions 6 so that the upper and lower surfaces of the tread slope or diverge relative to a horizontal at an angle ranging from 1 to 5 degrees as the surfaces extend toward the side portions 6. The slip prevention pattern 7 is also provided on the lower surface of the tread 5 so that the foothold 1 can be used reversibly (i.e., rotated upside down).

As shown in FIGS. 4 to 6, the reflector members 9 comprises a pair of reflectors 12 and 13 disposed in vertically opposed relation at the corner of the foothold. Each reflector has a substantially 90° elbow shape, and includes an inner quarter circular arc or wall 10 and an outer quarter circular arc or wall 11 joined by a back wall 31. Each cross section of the reflective reflectors 12 and 13 is of substantially U-shape. Respective reflectors 12 and 13 have hooks 14 along the free edge of the inner quarter circular wall 10 and hooks 15 along the free edge of the outer quarter circular wall 11. There are formed irregular reflector portions or surfaces 16 at the inner surfaces of the respective reflectors 12 and 13, and the reflectors 12 and 13 are formed of a colored high polymer material such as polycarbonate and acrylic resin, wherein the color of one reflector 12 is different from the color of the other reflector 13.

A convex portion (i.e., a protruding rib) 17 is formed on the inner surface of the central back wall of the reflector 12 along substantially the quarter circular arc thereof, and a concave portion 18 (i.e., a depressed groove) is formed on the inner surface of the central back wall of the reflector 13 along substantially the quarter circular arc. Further, slip prevention patterns 19 and 20 are also formed on the outer surfaces of the back walls of the reflectors 12 and 13.

In FIGS. 5 and 6, (A) are plan views of respective reflectors 12 and 13, (B) are substantially side elevational views of (A), (C) are bottom views of (A), and (D) are substantially side elevational views of (C).

Outward projections 21 and 22 are formed by the resin coating so as to extend centrally along the front and back sides of the corners formed between the tread 5 and the side portions 6. Grooves 23 and 24 for retaining the hooks 14 and 15 are respectively formed on the upper and lower surfaces of the respective projections 21 and 22, whereby the reflectors 12 and 13 are reliably retained at the comer of the foothold 1.

On the resin coating at the corners of the foothold, a concave portion (i.e., a groove) 25 is formed on the upper surface of one corner and on the lower surface of the other corner. The groove 25 extends around the corner through an arc of about 90° to mate with the convex rib portion 17 which is formed along the central back wall 31 of the reflector 12. A convex rib portion 26 is formed on the lower surface of said one corner and on the upper surface of said other corner. The rib 26 extends around the corner through an angle of about 90° to mate with the concave groove portion 18 which is formed along the central back wall 31 of the reflector 13. This arrangement prevents the respective reflectors 12 and 13 from being improperly positioned on the foothold 1. The color of the upper reflector of one reflector member 9 at one corner is the same as the color of the lower reflector of the same at the other comer.

It is advantageous, for example, in FIG. 1, that the color of the upper reflector 12 of the right reflector member 9 is red and the color of the lower reflector 13 of the same is green, while the color of the upper reflector 13 of the left reflector member 9 is green and the color of the lower reflector 12 of the same is red (the construction of the right and left reflector members 9 per se is the same).

With the arrangement of the preferred embodiment set forth above, inasmuch as the reflector members 9 comprises reflectors 12 and 13 which are provided at the corners formed between the tread 5 and side portions 6 and have different colors at the upper and lower portions thereof, wherein the convex portion 17 is formed at the back wall of the reflector 12 having one color while the concave portion 18 is formed at the back wall of the reflector 13 having another color, and the concave portion 25 and the convex portion 26 are formed on the foothold 1 respectively corresponding to the convex portion 17 and the concave portion 18, it is possible to prevent the respective reflectors 12 and 13 from being erroneously attached to the foothold 1.

Further, since the hooks 14 and hooks 15 of the respective reflectors 12 and 13 are respectively retained through the grooves 23 and 24 formed at the upper and lower surfaces of both corners formed between the tread 5 and side portions 6, the reflectors 12 and 13 can be reliably retained by the foothold 1, and hence there is no possibility that the reflector members 9 rattles against the foothold 1 even if the foothold 1 is used for a long period of time.

Further, since the color of the upper reflector of one reflector member 9 at one comer is the same as the color of the lower reflector at the other corner, the colors of upper and lower reflectors 12 and 13 of one and another reflector members 9 are not changed, and hence the positions of the foothold 1 are unified in respect of the right and left colors even if the foothold 1 is upside down when it is fixed to the body.

For example, if the reflector members 9 are respectively provided at both corners formed between the tread 5 and side portions 6 in the manner that the color of the upper reflector of the right reflector member 9 is red and the color of the lower reflector of the right reflector member 9 is green, while the color of the upper reflector of the left reflector member 9 is green and the color of the lower reflector of the left reflector member 9 is red, such colors are advantageous in the repair of a manhole or can sufficiently serve as the channel or direction mark by disposing the foothold corresponding to the upstream or downstream of the manhole or the river.

According to the first aspect of the invention, it is possible to clearly confirm the positions of the treads, and to easily confirm the foothold from the remote portion, particularly from the side portion thereof when a person goes up and down even in a dark environment because a set of reflector members are constituted by the upper and lower reflectors each having U-shape as viewed from the plane thereof and different colors, wherein one reflector has one color and a convex portion at the rear surface while another reflector has another color and a concave portion at the rear surface, and wherein the foothold has the concave or convex portion formed therein corresponding to the convex or concave portions formed in the respective reflectors, and also wherein respective reflectors are retained by the foothold so as to cover the upper and lower surfaces and the front and rear surfaces of the tread and the side portions with respective reflector members at both corners formed between the tread and side portions, and the color of the upper reflector at one corner is the same as that of the lower reflector at the other corner, leading to the effect that a person does not feel inconvenience at an emergency and also it is possible to prevent the reflectors mounted on the foothold from being differentiated in colors. Further, there are other effects that the colors of the upper and lower reflectors of one and the other reflector members are not changed even if the foothold is fixed to the body while the front and back thereof are turned upside down, so that the positions of the foothold 1 secure unity and exhibit excellent design without fixing the foothold again to the body, and the reflectors can be used for a long period of time without rattling against the foothold.

According to the second aspect of the invention, it is possible to obtain the foothold provided with reflectors which is advantageous for the repair of the manhole or sufficiently serve as the channel mark in addition to the effects as set forth above.

What is claimed is:

1. A foothold provided with reflectors and comprising a tread and side portions continued and positioned at both sides of the tread, further comprising:

a set of reflector members composed of upper and lower reflectors each having an elbow shape as viewed from the tops thereof and different colors;

a convex portion being formed on the back surface of one reflector having one color while a concave portion being formed on the back surface of another reflector having another color;

a concave portion and a convex portion being formed on the foothold corresponding to the convex portion and the concave portion of each reflector;

respective reflectors being retained by the foothold so as to cover the upper and lower surfaces and the front and rear surfaces of the tread and the side portions with respective reflector members at both corners formed between the tread and side portions, and the color of the upper reflector at one corner being the same as that of the lower reflector at the other corner.

2. The foothold provided with reflectors according to claim 1, wherein the upper reflector at one corner and the lower reflector at the other corner are respectively red while the lower reflector at one corner and the upper reflector at the other corner are respectively green.

3. The foothold according to claim 1, wherein the upper reflector at one corner and the lower reflector at the other corner are identical and of a first color, and wherein the lower reflector at said one corner and the upper reflector at said other corner are identical and of a second color which is different from said first color.

* * * * *